US008042345B2

(12) United States Patent
Nakajima

(10) Patent No.: US 8,042,345 B2
(45) Date of Patent: Oct. 25, 2011

(54) OUTDOOR UNIT AND AIR CONDITIONING SYSTEM USING THE SAME

(75) Inventor: Seiji Nakajima, Takasaki (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 639 days.

(21) Appl. No.: 12/239,399

(22) Filed: Sep. 26, 2008

(65) Prior Publication Data

US 2009/0077991 A1 Mar. 26, 2009

(30) Foreign Application Priority Data

Sep. 26, 2007 (JP) ..... 2007-248463

(51) Int. Cl.
*F25B 1/00* (2006.01)

(52) U.S. Cl. ..... 62/115; 62/259.1

(58) Field of Classification Search ..... 62/115, 62/129, 132, 230, 259.1, 278, 498; 700/276, 700/277

See application file for complete search history.

(56) References Cited

U.S. PATENT DOCUMENTS 5,278,822 A * 1/1994 Yashiki ..... 370/235
5,765,027 A * 6/1998 Wang et al. ..... 710/40
6,327,263 B1 * 12/2001 Nakatsuji ..... 370/442
7,129,668 B2 * 10/2006 Kuribayashi et al. ..... 318/625
7,400,243 B2 * 7/2008 Sumida et al. ..... 340/539.11
7,958,740 B2 * 6/2011 Hirai et al. ..... 62/150
2001/0036177 A1 * 11/2001 Hallenstal et al. ..... 370/354
2006/0273559 A1 * 12/2006 Uono et al. ..... 280/735

FOREIGN PATENT DOCUMENTS

JP 08-303842 11/1996

* cited by examiner

*Primary Examiner* — Mohammad Ali
(74) *Attorney, Agent, or Firm* — Westerman, Hattori, Daniels & Adrian, LLP

(57) ABSTRACT

An air conditioning system comprising: an indoor and an outdoor unit connected through common power supply lines The indoor unit comprising a first communications circuit in communication with the outdoor unit through first and second communication lines independent of the supply lines; and a second communication circuit that communicates through one of the supply lines and a third communication line. The outdoor unit comprising a third communication circuit in communication with one of the first and second communication circuits; a switch that connects or disconnects a communication terminal with one of the common power supply lines based on a connection status between the third communication circuit and the first and second communication circuits; and a judging circuit that controls the connection and disconnection, and judges, based on the presence of an acknowledge signal, whether the first and the second communication circuit is connected to the outdoor unit.

7 Claims, 12 Drawing Sheets

OUTDOOR UNIT AND AIR CONDITIONING SYSTEM USING THE SAME

CLAIM OF PRIORITY

The present application claims the benefit of priority, under 35 U.S.C. §119, of Japanese Patent Application No. 2007 248463, filed Sep. 26, 2007, which is incorporated herein by reference in its entirety.

FIELD OF THE INVENTION

The invention generally relates to an outdoor unit and an air conditioning system using the same.

BACKGROUND OF THE INVENTION

An air conditioning system in which an indoor unit and an outdoor unit are connected to each other and exchange information there between in the serial communication style is disclosed in JP-A-08-303842.

When communication is carried out between an indoor unit and an outdoor unit as in the case of the technique disclosed in JP-A-08-303842, two communication styles have been hitherto adopted. According to one communication style, communication is carried out by using a dedicated communication line, and according to the other communication style, communication is carried out by using a power supply line as a communication line.

Accordingly, when existing facilities adopt the former style, only indoor units and outdoor units which are adaptable to the former style can be added. Likewise, when existing facilities adopt the latter style, only indoor units and outdoor units which are adaptable to the latter style can be added. Therefore, there is a problem that the existing facilities cannot be effectively used or an optional range for indoor units and outdoor units to be added is narrowed.

SUMMARY OF THE INVENTION

In one aspect, the invention provides an air conditioning system comprising: an indoor unit and an outdoor unit connected to each other through common power supply lines; the indoor unit comprising: a first communications circuit configured to perform communication with the outdoor unit through at least one of a first communication line and a second communication line independent of the common power supply lines; a second communication circuit configured to perform communication through at least one of the two common power supply lines and a third communication line independent of the at least two common power supply lines; the outdoor unit comprising: a third communication circuit, having a communication terminal, configured to communicate with at least one of the first communication circuit and the second communication circuit; a switch configured to connect or disconnect the communication terminal of the third communication circuit and one of the common power supply lines on the basis of a connection status between the third communication circuit and each of the first communication circuit and the second communication circuit; and a judging circuit configured to control the switch connection and disconnection, and further configured to transmit a predetermined signal to the indoor unit, wherein the judging circuit is further configured to judge, based on the presence or absence of an acknowledge signal from the indoor unit, whether the first communication circuit and the second communication circuit is connected to the outdoor unit.

In another aspect the invention provides a communication control method for an air conditioning system having an indoor unit and an outdoor unit connected through common power supply lines, wherein the indoor unit has at least one of a first communication circuit configured to communicate through two communication lines that are independent of the common power supply lines and a second communication circuit configured to communicate through one of the common power supply lines and a communication line independent of the common power supply lines, wherein the outdoor unit has a third communication circuit configured to communicate with at least one of the first communication circuit and the second communication circuit, a switch configured to switch between a connection and a disconnection of at least one communication terminal of the third communication circuit and one of the common power supply lines based on a connection status between the third communication circuit and each of the first communication circuit and the second communication circuit, the method comprising the steps of: setting a switch to a connection state when the one communication terminal is connected to one of the common power supply lines; setting the switch to a disconnection state when the one communication terminal is disconnected from one of the common power supply lines; transmitting a predetermined signal to the indoor unit under each of the connection state and the disconnection state; and judging, based on the presence or absence of an acknowledge signal from the indoor unit, whether the first communication circuit and the second communication circuit is connected to the outdoor unit.

DETAILED DESCRIPTION OF THE EMBODIMENTS

Figure 1A:
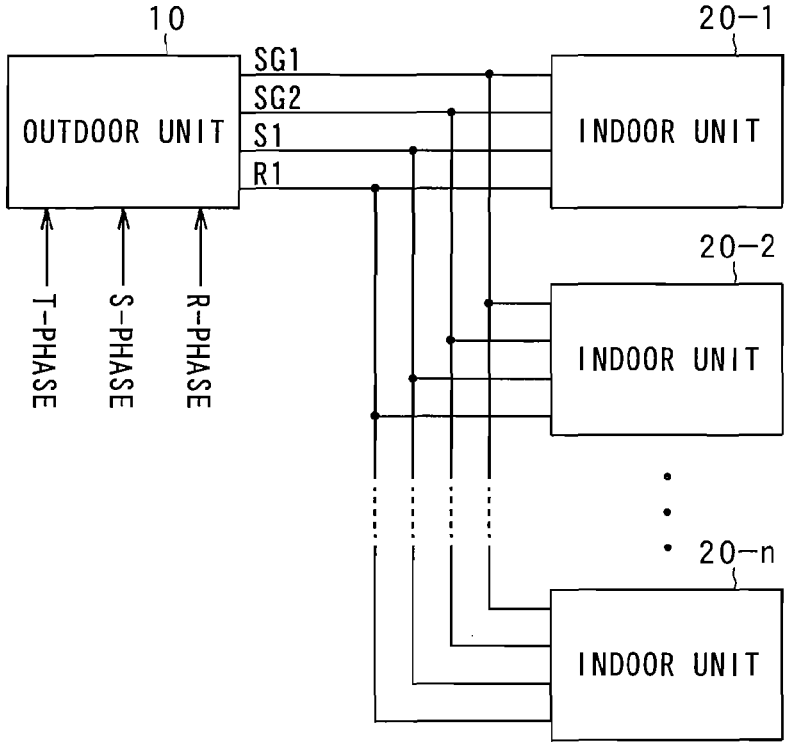
FIGS. 1A and 1B are diagrams showing the construction of an air conditioning system according to a first embodiment of the present invention.

An embodiment of the present invention provides an outdoor unit and an air conditioning system in which equipment can be easily added or replaced.

According to a first aspect of the present invention, an air conditioning system in which an indoor unit and an outdoor unit are connected to each other through common power supply lines is characterized in that the indoor unit has at least one of a first communication circuit for performing communications through two communication lines independent of the power supply lines and a second communication circuit for performing communications through one of the power supply lines and one communication line independent of the power supply lines, and the outdoor unit has a third communication circuit that is connected to the indoor unit having at least one of the first communication circuit and the second communication circuit and communicates with one of the first communication circuit and the second communication circuit, a switch for carrying out a switching operation between the connection and the disconnection of one of communication terminals of the third communication circuit and one of the power supply lines on the basis of a connection status between the third communication circuit and each of the first and second communication circuits, and a judging circuit for setting the switch to one of a connection state that the one communication terminal is connected to the one power supply line and a disconnection state that the one communication terminal is disconnected from the one power supply line, transmitting a predetermined signal to the indoor unit under each of the connection state and the disconnection state and judging, on the basis of the presence or absence of an acknowledge signal to the predetermined signal, which one of the first and second communication circuits is connected to the outdoor unit.

According to the above air-conditioning system, the switch is set to the connection state or the disconnection state, and the judging circuit transmits the predetermined signal to the indoor unit under each of the connection and disconnection states, detects the presence or absence of an acknowledge signal to the predetermined signal from the indoor unit, and judges on the basis of the presence or absence of the acknowledge signal which one of the first and second communication circuits is connected to the outdoor unit. As a result, facilities can be easily additionally provided or replaced.

In the above air-conditioning system, the judging circuit makes a judgment under the state that the switch is first set to the disconnection (non-connection) state.

According to the above air conditioning system, first, the switch is set to the disconnection (non-connection) state, and then the predetermined signal is transmitted to the indoor unit. Thereafter, the presence or absence of the acknowledge signal to the predetermined signal is judged. As a result, the detection under the connection state that both the first and second communication circuits can transmit an acknowledge is executed afterwards, whereby error detection can be prevented.

In the above air conditioning system, the indoor unit has both the first communication circuit and the second communication circuit, and the judging circuit of the outdoor unit judges which one of the first and second communication circuits is connected to the outdoor unit.

According to the above air conditioning system, any one of the first and second communication circuits provided to the indoor unit can be selected and connected to the outdoor unit (e.g., the third communication circuit). Accordingly, an indoor unit can be additionally provided or replaced irrespective of the communication system adopted by the existing facilities.

Furthermore, in the above air conditioning system, one of the communication terminals of the third communication circuit is a terminal connected to the ground of the third communication circuit, and the switch connects the terminal connected to the ground of the third communication circuit to one of the power supply lines.

According to the above air conditioning system, when the switch is set to the connection state, the ground of the third communication circuit and one of the power supply lines are connected to each other. Accordingly, when an indoor unit adopting a communication system using a power supply line is connected, communication can be stably performed.

According to a second aspect of the present invention, an outdoor unit that is connectable through common power supply lines to an indoor unit having at least one of a first communication circuit for performing communications through two communication lines independent of the power supply lines and a second communication circuit for performing communications through one of the power supply lines and one communication line independent of the power supply lines, is characterized in that the outdoor unit has a third communication circuit for communicating with one of the first communication circuit and the second communication circuit when the outdoor unit is connected to the indoor unit, a switch for carrying out a switching operation between the connection and the disconnection of one of communication terminals of the third communication circuit and one of the power supply lines on the basis of a connection status between the third communication circuit and each of the first and second communication circuits, and a judging circuit for setting the switch to one of a connection state that the one communication terminal is connected to the one power supply line and a disconnection state that the one communication terminal is disconnected from the one power supply line, transmitting a predetermined signal to the indoor unit under each of the connection state and the disconnection state and judging, on the basis of the presence or absence of an acknowledge signal to the predetermined signal, which one of the first and second communication circuits is connected to the outdoor unit.

According to the above outdoor unit, the switch is set to the connection state or the disconnection state, and the judging circuit transmits the predetermined signal to the indoor unit under each of the connection and disconnection states, detects the presence or absence of an acknowledge signal to the predetermined signal from the indoor unit, and judges on the basis of the presence or absence of the acknowledge signal which one of the first and second communication circuits is connected to the outdoor unit. As a result, facilities can be easily additionally provided or replaced.

According to a third aspect of the present invention, a communication control method for an air conditioning system in which an indoor unit and an outdoor unit are connected to each other through common power supply lines, the indoor unit has at least one of a first communication circuit for performing communications through two communication lines independent of the power supply lines and a second communication circuit for performing communications through one of the power supply lines and one communication line independent of the power supply lines, and the outdoor unit has a third communication circuit that is connected to the indoor unit having at least one of the first communication circuit and the second communication circuit and communicates with one of the first communication circuit and the second communication circuit, and a switch for carrying out a switching operation between the connection and the disconnection of one of communication terminals of the third communication circuit and one of the power supply lines on the basis of a connection status between the third communication circuit and each of the first and second communication circuits, comprises the steps of: setting the switch to one of a connection state that the one communication terminal is connected to the one power supply line and a disconnection state that the one communication terminal is disconnected from the one power supply line; transmitting a predetermined signal to the indoor unit under each of the connection state and the disconnection state; and judging, on the basis of the presence or absence of an acknowledge signal to the predetermined signal, which one of the first and second communication circuits is connected to the outdoor unit.

According to the above communication control method, the switch is set to the connection state or the disconnection state, the predetermined signal is transmitted to the indoor unit under each of the connection and disconnection states, the presence or absence of an acknowledge signal to the predetermined signal from the indoor unit is detected, and on the basis of the presence or absence of the acknowledge signal, it is judged which one of the first and second communication circuits is connected to the outdoor unit. As a result, facilities can be easily additionally provided or replaced.

According to an embodiment of the present invention, there can be easily provided an outdoor unit, an air conditioning system using the outdoor unit and a communication control method for the air conditioning system with which equipment can be easily additionally provided or replaced.

Embodiments according to the present invention are described hereunder with reference to the accompanying drawings.

(A) Construction of First Embodiment

Figure 1B:
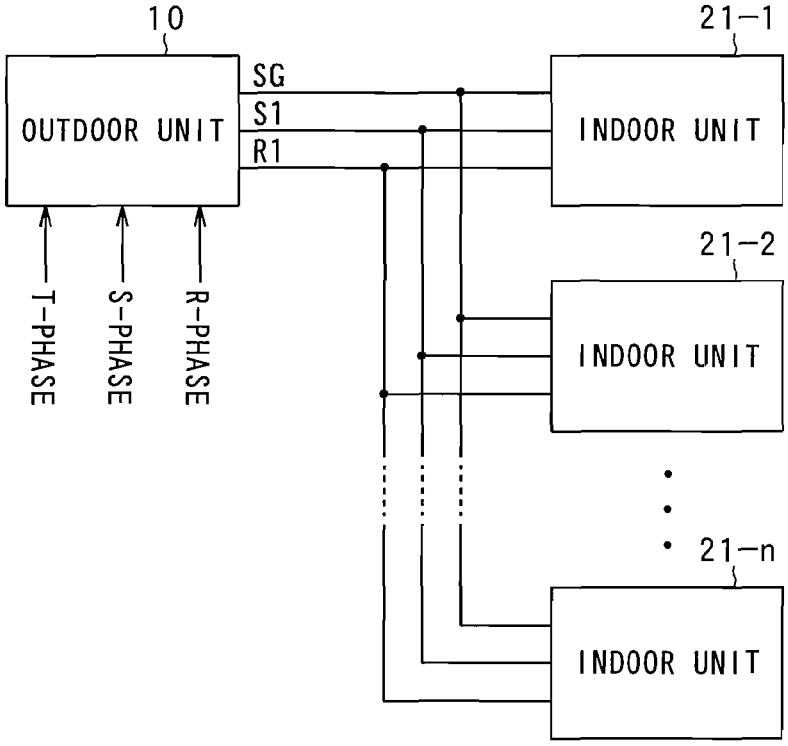

FIGS. 1A and 1B are diagrams showing the construction of a first embodiment of the present invention. FIG. 1A shows the construction when indoor units 20-1 to 20-*n* are connected to an outdoor unit 10 to perform communications by using two communication lines (SG2,SG2) which are independent of power supply lines, and FIG. 1B shows an example of the construction when indoor units 21-1 to 21-*n* are connected to an outdoor unit 10 to perform communications by using one (S1) of power supply lines and one communication line (SG) independent of power supply lines. In the former case, the outdoor unit 10 and the indoor units 20-1 to 20-*n* are connected to one another through four connection lines, and thus this will be referred to as "4-wire type". In the latter case, the outdoor unit 10 and the indoor units 21-1 to 21-*n* are connected to one another through three connection lines, and thus this will be referred to as 3-wire type". In the following description, the communication control method for the air conditioning system will be described as the operation of the air conditioning system.

More specifically, in FIG. 1A, the outdoor unit 10 and the indoor units 20-1 to 20-*n* are mutually connected to one another through two communication lines SG1, SG2 and two power supply lines S1, R1. The outdoor unit 10 and the indoor units 20-1 to 20-*n* are connected to the communication lines SG1, SG2 in a bus style, and perform communications in a serial communication style. Furthermore, the power supply lines S1, R1 supplies the indoor units 20-1 to 20-*n* with S-phase and R-phase power out of three-phase AC power of R-phase, S-phase and T-phase supplied to the outdoor unit 10.

In FIG. 1B, the outdoor unit 10 and the indoor units 21-1 to 21-*n* are mutually connected to one another through one communication line SG and two power supply lines S1, R1. A serial signal is transmitted to the communication line SG and the power supply line S1. The outdoor unit 10 and the indoor units 21-1 to 21-*n* are connected to the communication line SG and the power supply line S1 in a bus style. Furthermore, the power supply lines S1, R1 supply the indoor units 21-1 to 21-*n* with S-phase and R-phase power out of three-phase AC power of R-phase, S-phase and T-phase supplied to the outdoor unit 10.

Figure 2:
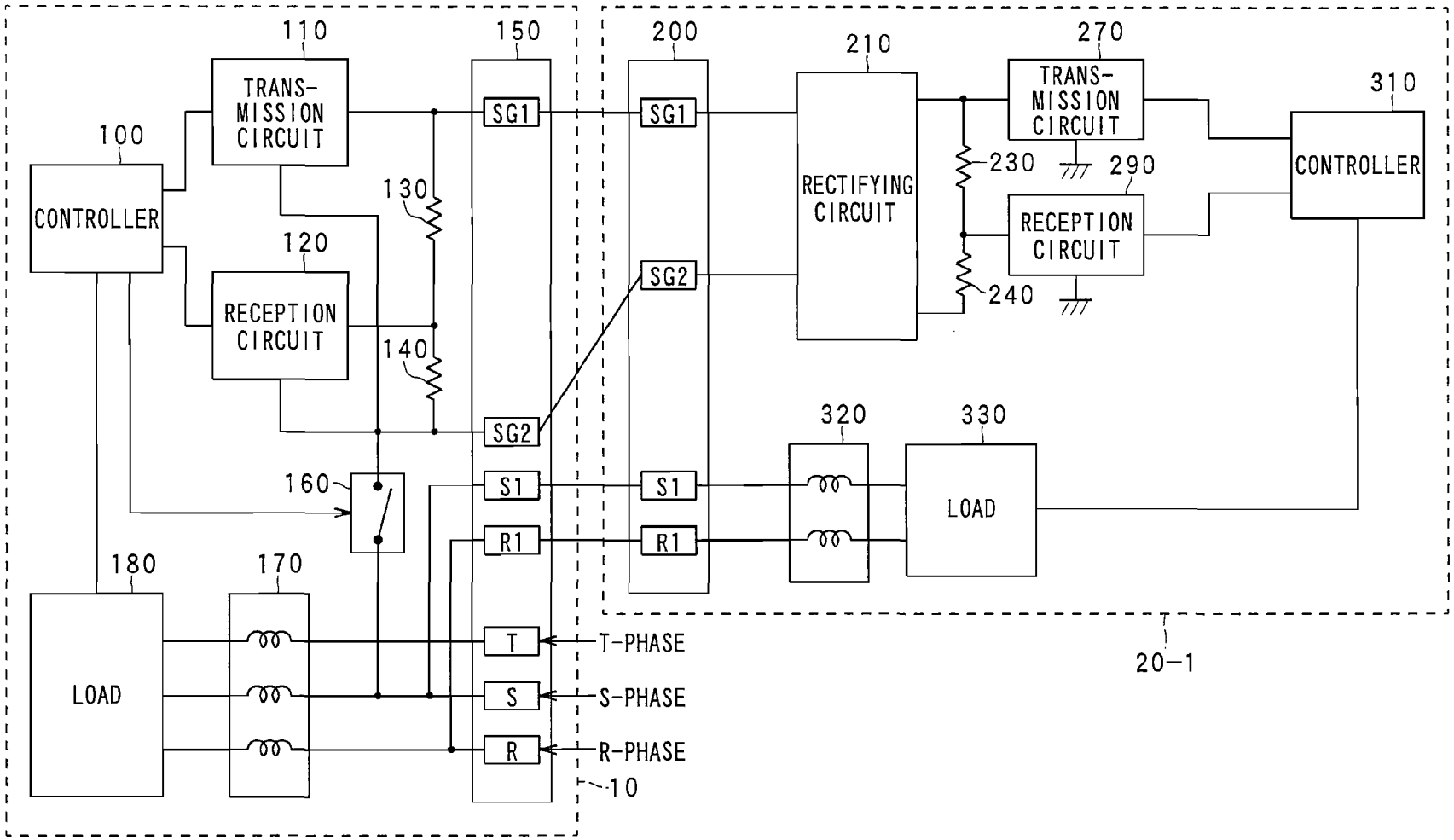
FIG. 2 is a block diagram showing the construction shown in FIG. 1A.

FIG. 2 is a block diagram showing an example of the electrical construction of the outdoor unit 10 and the indoor unit 20-1 shown in FIG. 1A. The indoor units 20-1 to 20-*n* have the same construction, and thus the following description will be made by representatively using the indoor unit 20-1.

As shown in FIG. 2, the outdoor unit 10 mainly comprises a controller 100 (corresponding to "judging circuit" in claims), a transmission circuit 110 ("third communication circuit" in claims), a reception circuit 120 ("third communication circuit" in claims), resistors 130, 140, a terminal table 150, a switch 160 ("switch" in claims), a noise filter 170 and a load 180.

Here, the controller 100 comprises CPU (Central Processing Unit), ROM (Read Only Memory), RAM (Random Access Memory), etc., and it communicates with the indoor units 20-1 to 20-*n* through the transmission circuit 110 and the reception circuit 120 and also controls the load 180, etc. on the basis of the communication result or the like. The transmission circuit 110 generates a serial signal on the basis of data supplied from the controller 100, and transmits the serial signal to the indoor units 20-1 to 20-*n* through the terminal table 150. The reception circuit 120 receives the serial signal transmitted from the indoor units 20-1 to 20-*n*, restores the serial signal to the original data and supplies the original data to the controller 100. The resistors 130, 140 function as input/output resistors for the transmission circuit 110 and the reception circuit 120. The communication lines SG1, SG2, the power supply lines S1, R1 and the three-phase AC power supply lines (the lines corresponding to T-phase, S-phase and R-phase in FIG. 2) are connected to the terminal table 150.

The switch 160 is may be an electromagnetic relay or the like. When it is set to ON-state, it connects the ground of the transmission circuit 110 and the reception circuit 120 to the S-phase of the power supply. The noise filter 170 is a filter for removing or attenuating noise superposed on the three-phase AC power, and may be a low pass filter. The load 180 may include, but is not limited to a compressor for compressing refrigerant, an air blowing fan, a stepping motor for controlling or an outdoor expansion valve.

The indoor unit 20-1 mainly comprises a terminal table 200, a rectifying circuit 210, resistors 230, 240, a transmission circuit 270 (corresponding to "first communication circuit" in claims), a reception circuit 290 (corresponding to "first communication circuit" in claims), a controller 310, a noise filter 320 and a load 330. Here, communication lines SG1, SG2 and power supply lines S1, R1 are connected to the terminal table 200. The rectifying circuit 210 rectifies serial signals (signals having a low or high state) transmitted through the communication lines SG1, SG2. Accordingly, the serial signal is nonpolarized, and communication is enabled irrespective of which terminal of the terminal table the communication lines SG1, SG2 are connected to. The resistors 230, 240 function as input/output resistors for the transmission circuit 270 and the reception circuit 290.

The transmission circuit 270 converts data supplied from the controller 310 to a serial signal, and transmits the serial signal through the rectifying circuit 210 and the terminal table 200. The reception circuit 290 receives the serial signal transmitted from the outdoor unit 10, restores the serial signal to the corresponding data and then supplies the data concerned to the controller 310. The controller 310 is constructed by CPU, ROM, RAM, etc., for example, and it communicates with the outdoor unit through the transmission circuit 270 and the reception circuit 290 and also controls the load 330 and the other units on the basis of the communication result, etc.

Figure 3:
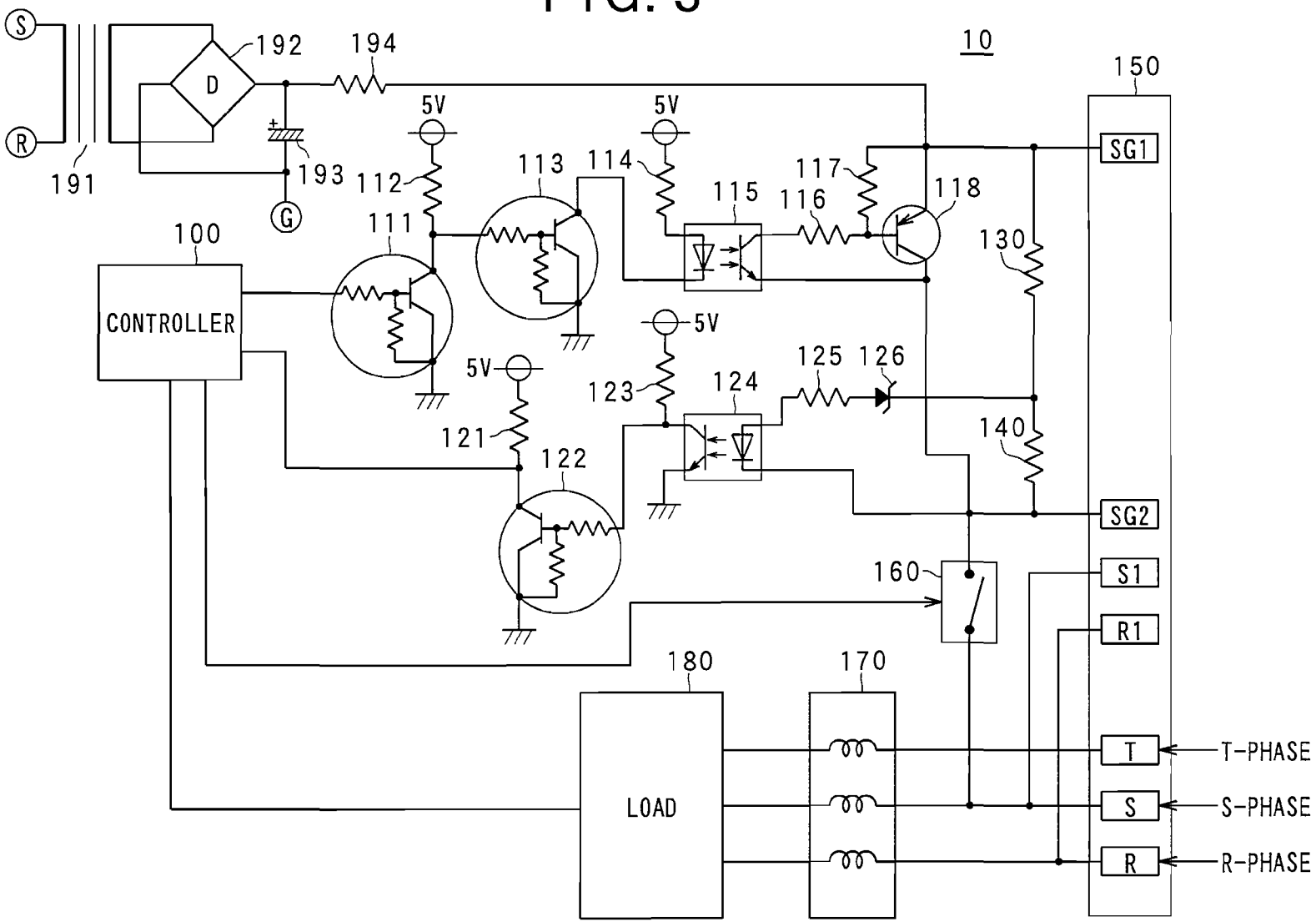
FIG. 3 is a circuit diagram showing the construction of an outdoor unit shown in FIG. 2.

FIG. 3 is a circuit diagram showing an example of the detailed construction of the outdoor unit 10 shown in FIG. 2. As shown in FIG. 2, the outdoor unit 10 mainly comprises a controller 100, transistors 111, 113, 118, 122, resistors 112, 114, 116, 117, 121, 123, 125, 130, 140, photocouplers 115, 124 and a load 180. The emitter of the transistor 118 is supplied with DC power generated by a power supply circuit having a transformer 191, a bridge diode 192, a capacitor 193 and a resistor 194.

Here, the transistors 111, 113, 118, the resistors 112, 114, 116, 117 and the photocoupler 115 constitute the transmission circuit 110. The transistor 122, the resistors 121, 123, 125, the zener diode 126 and the photocoupler 124 constitute the reception circuit 120.

The transistors 111, 113 and the resistor 112 constitute a non-inverting amplifying circuit that amplifies data output from the controller 100 and supplies the amplified data to the photocoupler 115. The photocoupler 115 emits light from a built-in LED (Light Emitting Diode) in accordance with current flowing in the collector of the transistor 113, receives the light by a built-in photodiode to convert the intensity of the light to an electrical signal and then outputs the electrical signal. The transistor 118 and the resistors 116, 117 switch the power supply voltage (for example, 24V) supplied from the resistor in accordance with the output of the photocoupler 115, and output the voltage to both the ends of the resistors 130, 140.

The function of the zener diode 126 is to waveform-shape the voltage applied across the resistor 140. The resistor 125 limits current flowing to the input side of the photocoupler 124. The photocoupler 124 emits light from a built-in LED in accordance with the voltage output from the resistor 125, converts the light to an electrical signal by a built-in photodiode and then outputs the electrical signal. The resistor 123 limits the current flowing in the photocoupler 124 and the transistor 122. The transistor 122 and the resistor 121 constitute an inverting amplifying circuit that inverts and amplifies the output voltage of the photocoupler 124 and supplies the inverted and amplified output voltage to the controller 100.

When the switch 160 is set to ON-state in accordance with the control of the controller 100, the switch 160 connects the ground side of the transmission circuit 110 and the reception circuit 120 (the collector side of the transistor 118) to the S-phase of the three-phase AC (the input side of the noise filter 170). Each of the T-phase, S-phase and R-phase of the three-phase AC power supplied to the terminal table 150 is supplied to the load 180 through the noise filter 170. The S-phase and the R-phase are also supplied to the indoor units 20-1 to **20-*n* through the terminal table 150**.

Figure 4:
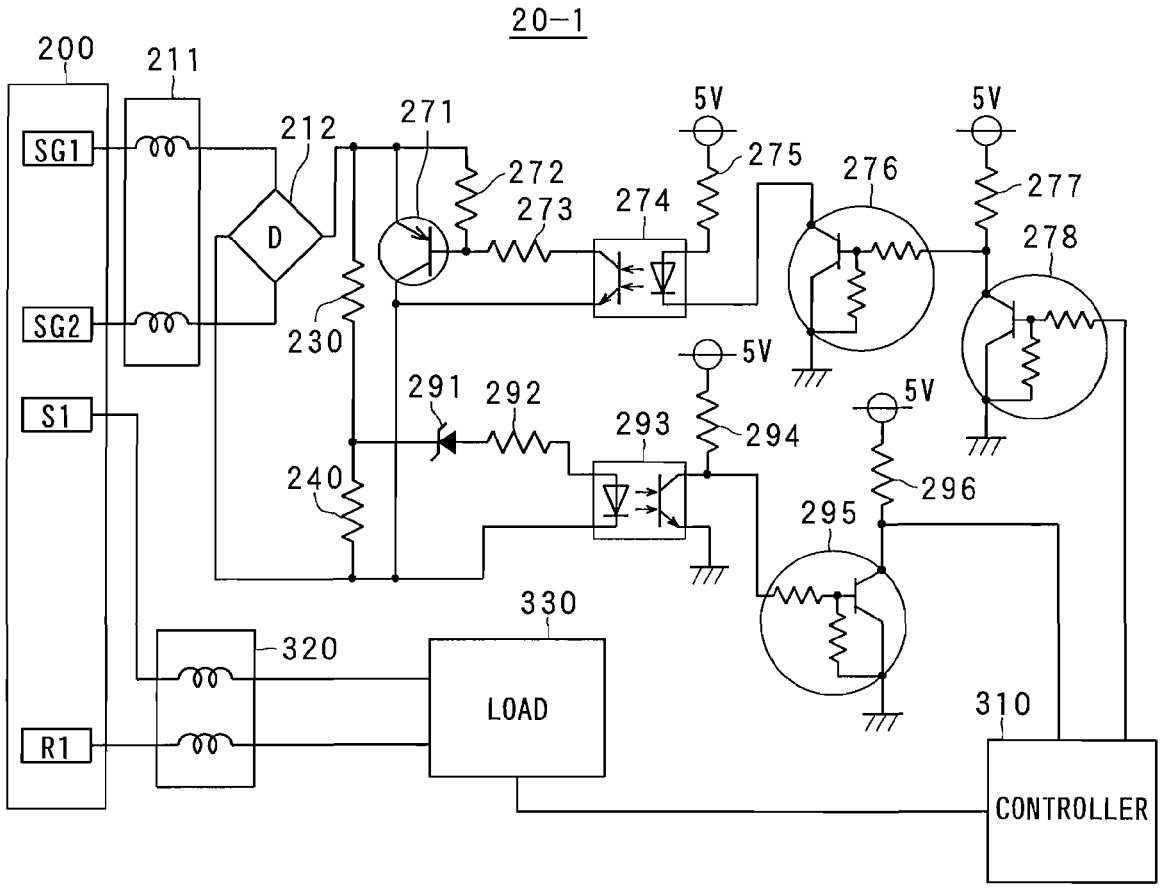
FIG. 4 is a circuit diagram showing the construction of an indoor unit shown in FIG. 2.

FIG. 4 is a circuit diagram showing an example of the detailed construction of the indoor unit 20-1 shown in FIG. 2. The indoor unit 20-1 mainly comprises a terminal 200, noise filters 211, 320, a bridge diode 212, resistors 230, 240, 272, 273, 275, 277, 292, 294, 296, transistors 271, 276, 278, 295, photocouplers 274, 293, a zener diode 291, a controller 310 and a load 330. The noise filter 211 and the bridge diode 212 constitute a rectifying circuit 210. The transistors 271, 276, 278, the resistors 272, 273, 275, 277 and the photocoupler 274 constitute the transmission circuit 270. The transistor 295, the resistors 292, 294, 296, the zener diode 291 and the photocoupler 293 constitute the reception circuit 290.

Here, the transistors 278, 276 and the resistor 277 constitute a non-inverting amplifying circuit, and it inverts and amplifies the signal output from the controller 310 and supplies the inverted and amplified signal to the photocoupler 274. The photocoupler 274 emits light from a built-in LED in accordance with current flowing in the collector of the transistor 276, converts the emitted light to an electrical signal by a built-in photodiode and outputs the electrical signal. The transistor 271 amplifies the output of the photocoupler 274 and outputs the amplified output to the resistors 230, 240.

The zener diode 291 shapes the waveform of the voltage appearing at the resistor 240 and outputs the waveform-shaped voltage. The resistor 292 limits the current flowing to the input terminal of the photocoupler 293. The photocoupler 293 emits light from a built-in LED in accordance with current flowing through the resistor 292, and outputs the voltage corresponding to the intensity of the emitted light by a built-in photodiode. The transistor 295 and the resistor 296 constitute an inverting amplifying circuit that inverts the output of the photocoupler 293 and outputs it to the controller 310.

The noise filter 320 is inserted between the terminal table 200 and the load 330, and removes or attenuates high frequency components contained in power supplied from the outdoor unit 10 through the power supply line. The load 330 is constructed by the air blowing fan, the stepping motor for controlling the indoor expansion valve, etc.

Figure 5:
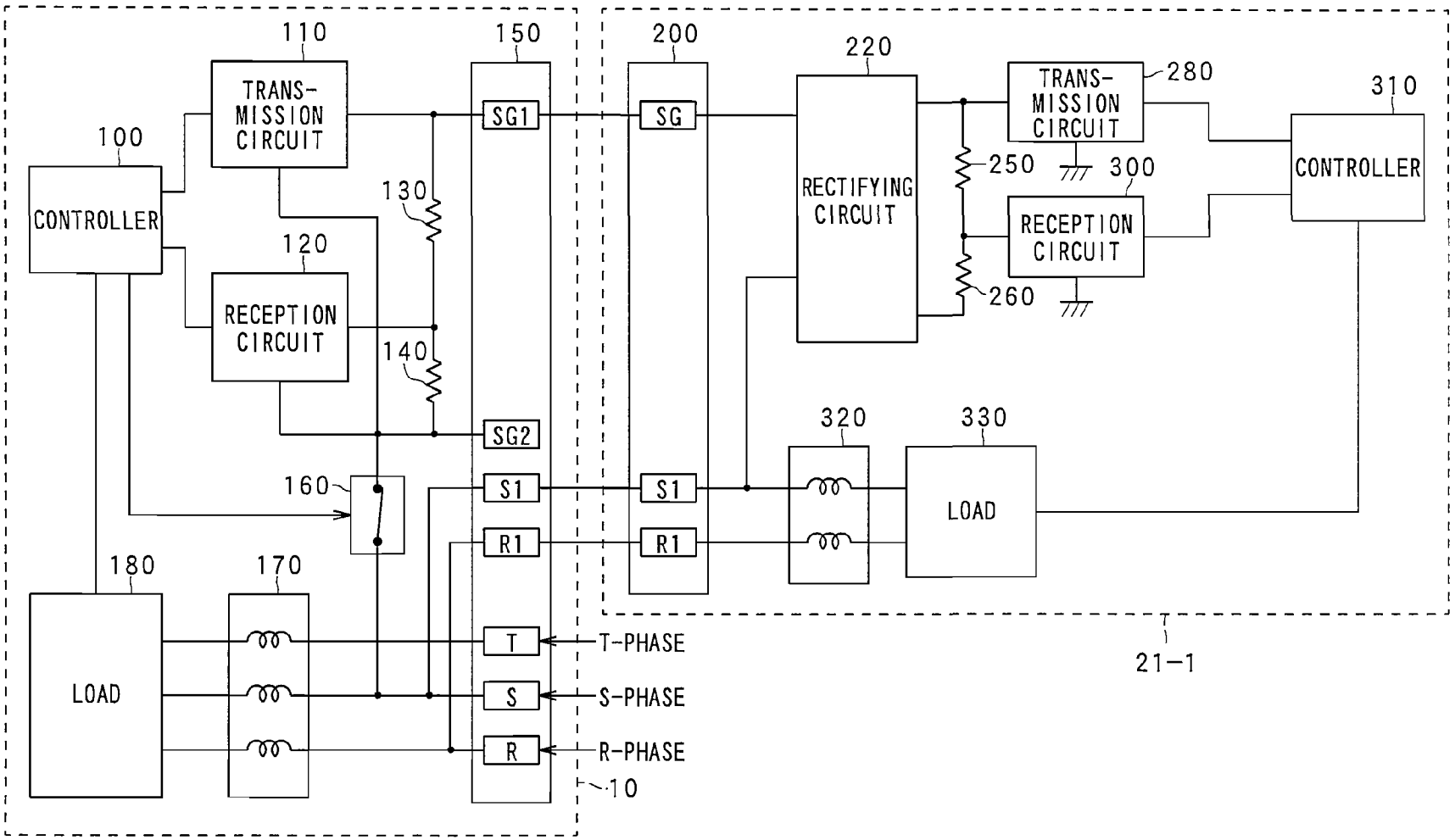
FIG. 5 is a block diagram showing the construction shown in FIG. 1B.

FIG. 5 is a block diagram showing an example of the electrical construction of the outdoor 10 and the indoor unit 21-1 shown in FIG. 1B. The indoor units 21-1 to **21-*n* have the same construction, and thus the description will be made hereunder by using the indoor unit 21-1 representatively. The outdoor unit 10 has the same construction as shown in FIG. 2**, and thus the description thereof is omitted.

As shown in FIG. 5, the indoor unit 21-1 mainly comprises a terminal table 201, a rectifying circuit 220, resistors 250, 260, a transmission circuit 280 (corresponding to "first communication circuit" in claims), a reception circuit 300 (corresponding to "second communication circuit" in claims), a controller 310, a noise filter 320 and a load 330. The corresponding parts to those of FIG. 2 are represented by the same reference numerals.

Here, a communication line SG1 and power supply lines S1, R1 are connected to the terminal table 201. The rectifying circuit 220 rectifies serial signals transmitted through the communication line SG and the power supply line S1, thereby nonpolarizing the serial signals. The resistors 250, 260 function as input/output resistors for the transmission circuit 280 and the reception circuit 300. The transmission circuit 280 converts data supplied from the controller 310 to a serial signal, and transmits the serial signal through the rectifying circuit 220 and the terminal table 201. The reception circuit 300 receives the serial signal from the outdoor unit 10, restores the serial signal to the corresponding data and then supplies the restored data to the controller 310. The controller 310 is constructed by CPU, ROM, RAM, etc., and it communicates with the outdoor unit 10 through the transmission circuit 280 and the reception circuit 300, and also controls the load 330, etc. on the basis of the communication result or the like.

Figure 6:
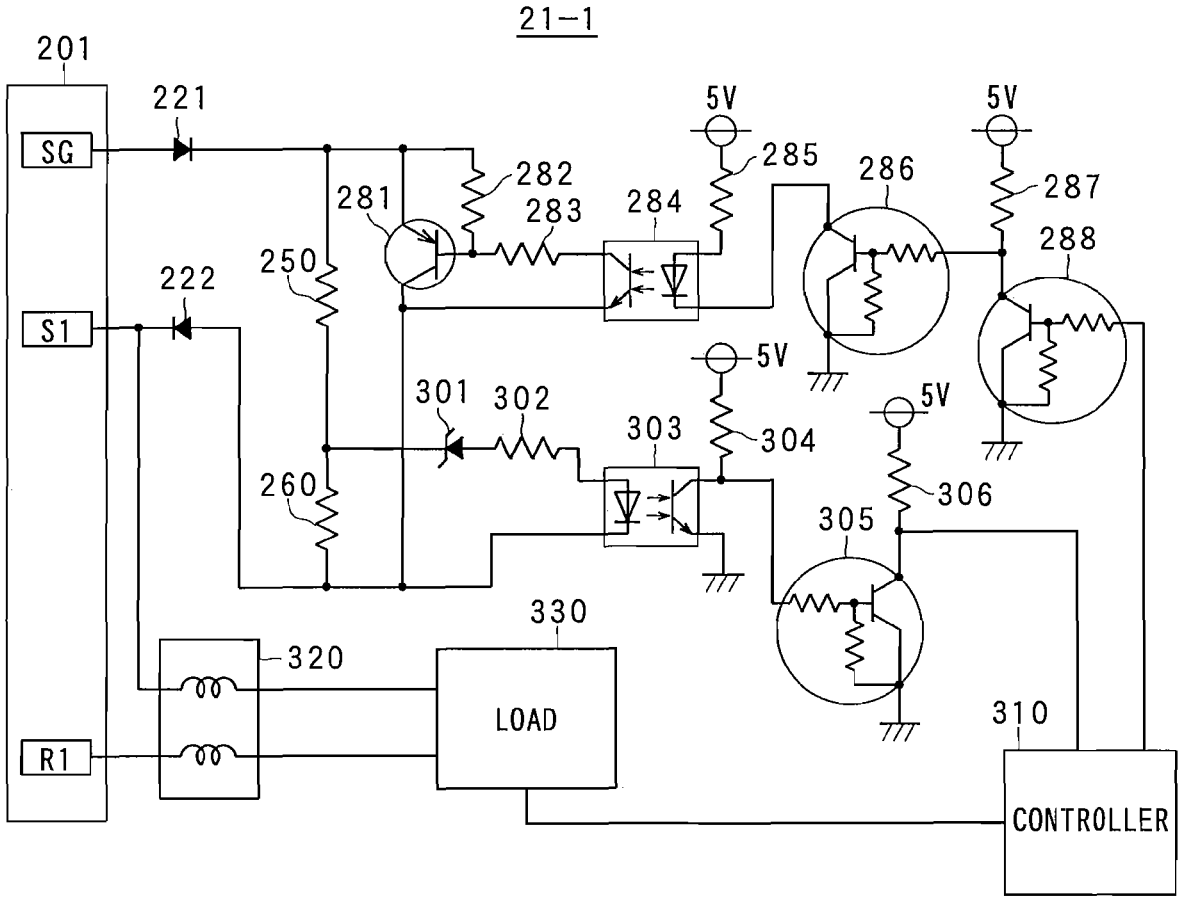
FIG. 6 is a circuit diagram showing the construction of the indoor unit shown in FIG. 5.

FIG. 6 is a circuit diagram showing an example of the detailed construction of the indoor unit 21-1 shown in FIG. 5. As shown in FIG. 6, the indoor unit 21-1 mainly comprises a terminal table 201, diodes 221, 222, resistors 250, 260, 282, 283, 285, 287, 302, 304, 306, transistors 281, 286, 288, 305, photocouplers 284, 303, a zener diode 301, a controller 310, a noise filter 320 and a load 330. The diodes 221, 222 constitute a rectifying circuit 220. The transistors 281, 286, 288, resistors 282, 283, 285, 287 and a photocoupler 248 constitute a transmission circuit 280. The transistor 305, resistors 302, 304, 306, a zener diode 301 and a photocoupler 303 constitute a reception circuit 300.

Here, the transistors 288, 286 and the resistor 287 constitutes a non-inverting amplifying circuit, and it inverts and amplifies the output from the controller 310 and supplies it to the photocoupler 284. The photocoupler 284 emits light from a built-in LED in accordance with current flowing in the collector of the transistor 286, converts the light from the LED to an electrical signal by a built-in photodiode and outputs the electrical signal concerned. The transistor 281 amplifies the output of the photocoupler 284 and outputs the amplified output to the resistors 250, 260.

The zener diode 301 waveform-shapes the voltage appearing at the resistor 260 and outputs the waveform-shaped voltage. The resistor 302 limits current flowing to the input terminal of the photocoupler 303. The photocoupler 303 emits light from a built-in LED in accordance with the current flowing through the resistor 302 and outputs the voltage corresponding to the intensity of the light from a built-in photodiode. The transistor 305 and the resistor 306 constitute an inverting and amplifying circuit that inverts the output of the photocoupler 303 and outputs it to the controller 310.

The noise filter 320 is inserted between the terminal table 201 and the load 330, and removes or attenuates high frequency components contained in the power supplied from the outdoor unit 10 through the power supply line. The load 330 is constructed by the air blowing fan, the stepping motor for controlling the indoor expansion valve, etc.

(B) Operation of First Embodiment

Figure 7:
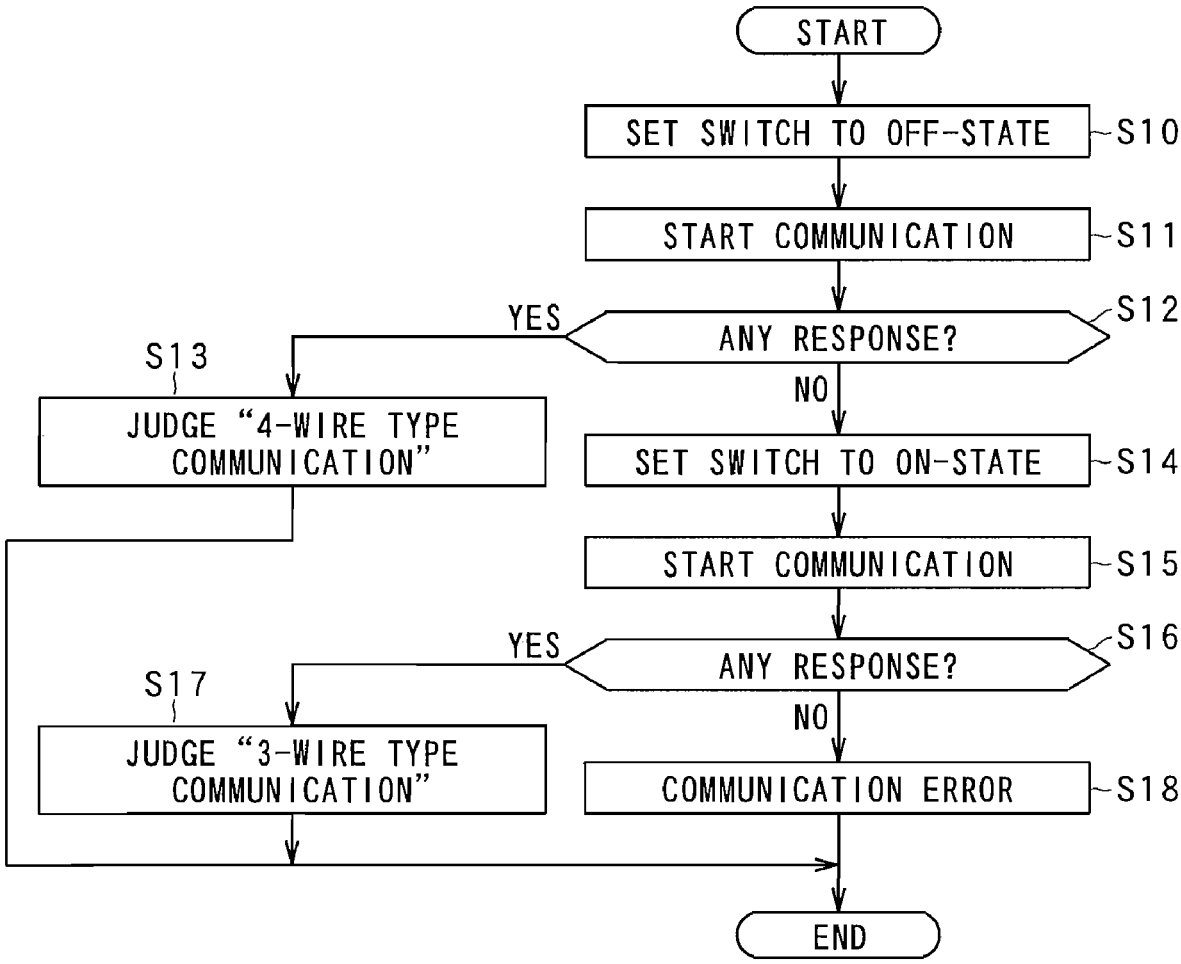
FIG. 7 shows an example of processing executed in the outdoor unit.

Next, the operation of the first embodiment will be described with reference to FIG. 7. As a condition for execution of the operation of FIG. 7, the indoor units 20-1 to **20-*n* or indoor units 21-1 to 21-*n* are newly installed together with the outdoor unit 10, the outdoor unit 10 is newly installed and the indoor units 20-1 to 20-*n* or indoor units 21-1 to 21-*n* have been previously installed, or the indoor units 20-1 to 20-*n* or the indoor units 21-1 to 21-*n* are newly installed the outdoor unit 10 has been previously installed. When the power of the outdoor unit 10 is turned on after the installation work is finished, the processing shown in FIG. 7 is executed. A program for executing the processing shown in FIG. 7 is stored in ROM (not shown) of the controller 100 of the outdoor unit 10 shown in FIG. 2**.

Figure 8A:
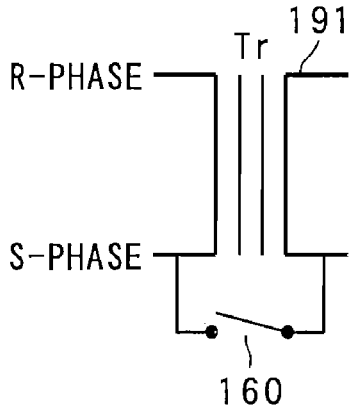
FIGS. 8A, 8B, and 8C are diagrams showing the connection relationship between a switch and a transformer.
Figure 8B:
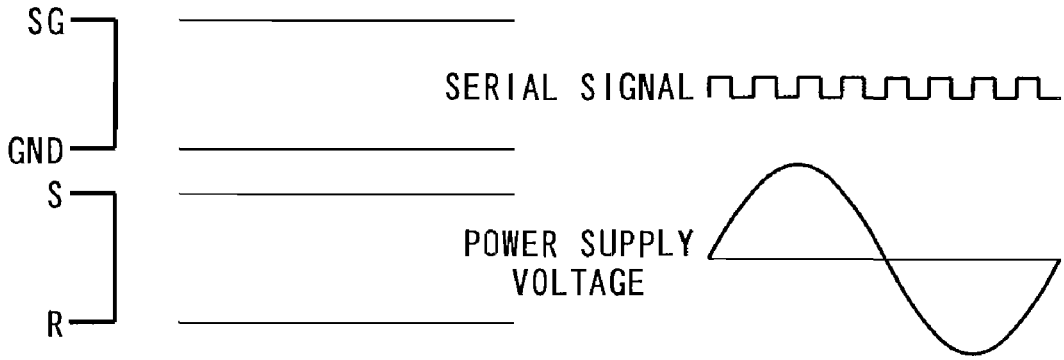
Figure 9A:
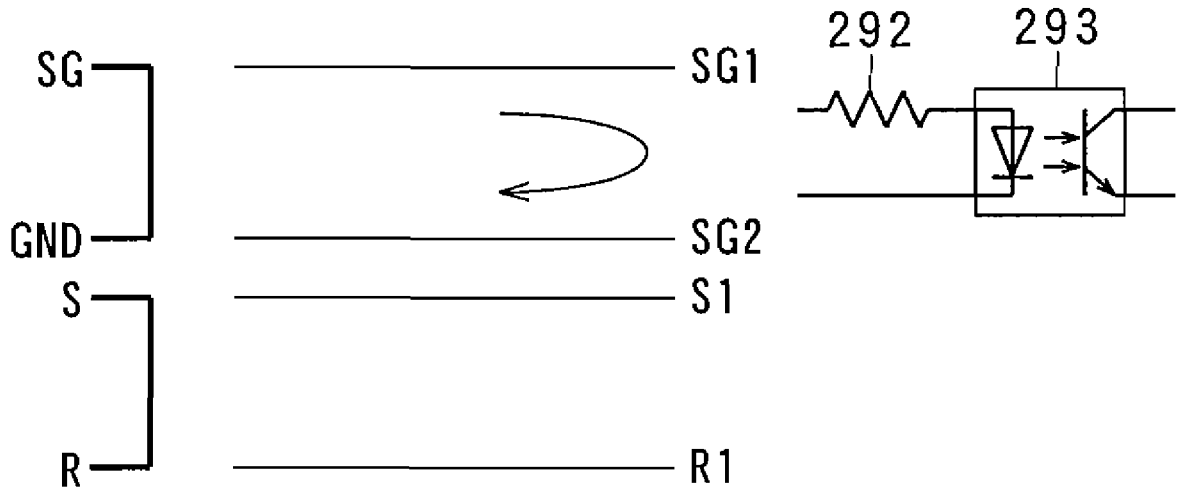
FIGS. 9A and 9B are diagrams showing the connection state between a transformer and a photocoupler.

When the processing shown in FIG. 7 is started, the controller 100 sets the switch 160 to OFF-state (step S10). As a result, the ground of the transmission circuit 110 and the reception circuit 120 are set to be separated from the S-phase of the power source. More specifically, as shown in FIG. 8A, The transformer 191 for supplying power to the transmission circuit 110 and the reception circuit 120 is designed so that the primary side and the secondary side thereof are insulated from each other and they are connected to or disconnected from each other by the switch 160. When the switch 160 is set to OFF-state, the S-phase and the ground (GND) are separated from each other as shown in FIG. 8B, and thus AC power and the serial signal are separately transmitted as separate signals. As a result, as shown in FIG. 9A, the signal transmitted through the communication lines SG1, SG2 is received by the photocoupler 293.

In step S11, the controller 100 instructs the transmission circuit 110 to start the communication. As a result, the data supplied from the controller 100 are amplified by the transistors 111, 113 constituting the transmission circuit 110, and the amplified data are supplied to the photocoupler 115. The photocoupler 115 emits light from the built-in LED in accordance with the collector current of the transistor 113 and outputs the voltage corresponding to the intensity of the emitted light from the built-in photodiode. The output of the photodiode 115 is supplied to the transistor 118. The power (for example, 24V) from the transformer 191 is supplied to the transistor 118, and the transistor 118 switches the power supply voltage in accordance with the output of the photocoupler 115 and outputs it to the resistors 130, 140.

At this time, when the connection style shown in FIG. 1A is adopted, the signal output from the resistors 130, 140 is supplied through the communication lines SG1, SG2 to the indoor units 20-1 to **20-*n* as shown in FIG. 2. In the indoor unit 20-1 receiving the signal as described above, noise contained in the serial signal is removed by the noise filter 211, and the noise-removed serial signal is amplified by the bridge diode 212 and then applied to the resistors 230, 240. The voltage appearing at the resistor 240 is waveform-shaped by the zener diode 291, and then supplied through the resistor 292 to the photocoupler 293. The photocoupler 293 outputs the voltage corresponding to the voltage supplied through the resistor 292, and supplies the voltage concerned to the transistor 295. The transistor 295 inverts the output voltage of the photocoupler 293 and supplies the inverted output voltage to the controller 310. The controller 310 receiving the communication signal recognizes that the signal from the outdoor unit 10 is received, and an acknowledge signal thereto is output to the transistor 278. The transistors 278, 276 amplify the output of the controller 310 and supplies the amplified output to the photocoupler 274. The voltage corresponding to the collector current of the transistor 276 is output from the photocoupler 274, and supplied to the transistor 271. The transistor 271 outputs the output voltage corresponding to the output of the photocoupler 274 to the resistors 230, 240. The voltage appearing at the resistors 230, 240 is transmitted to the outdoor unit 10 through the communication lines SG1, SG2. The above operation is independently executed in each indoor unit. However, the controller of each indoor unit monitors the state of the communication lines SG1, SG2 by the reception circuit, and it transmits an acknowledge signal after it is checked that no signal is transmitted on the communication lines SG1, SG2. Accordingly, signal collision on the communication lines SG1, SG2** can be avoided.

The signal transmitted from the indoor unit 20-1 is transmitted through the communication lines SG1, SG2 to the outdoor unit 10. In the outdoor unit 10, the voltage supplied from the communication lines SG1, SG2 appear at the resistors 130, 140. The voltage (reception signal) appearing at the resistor 140 is waveform-shaped by the zener diode 126, and then supplied to the photocoupler 124 through the resistor 125. The output corresponding to the voltage appearing at the resistor 140 occurs at the output side of the photocoupler 124, and the transistor 122 inverts and amplifies the output voltage and supplies it to the controller 100. The controller 100 receives the output voltage of the transistor 122, and returns it to the original data, thereby recognizing that there is an acknowledge from the indoor unit 20-1.

Alternatively, when the connection style shown in FIG. 1B is adopted in the communication style described above, the switch 160 is set to OFF-state in FIG. 5. In this case, the ground side of the transmission circuit 110 and the reception circuit 120 are set to Open-state, so that the outdoor unit 10 is set not to be connected to the indoor units 21-1 to **21-*n* through the communication lines. Therefore, the outdoor unit cannot communicate with the indoor units 21-1 to 21-*n*. Accordingly, in such a case, even when the outdoor unit 10** starts the communication, no response (acknowledge) is transmitted from the indoor units 21-1 to **21-*n***.

As described above, when the communication is started in step S11, an acknowledge is transmitted from the indoor units 20-1 to **20-*n* if the connection style of FIG. 1A is adopted. Alternatively, if the connection style of FIG. 1B is adopted, no acknowledge is transmitted from the indoor units 21-1 to 21-*n*. Accordingly, in step S12, when the connection style of FIG. 1A is adopted, it is judged that there is an acknowledge (step S12; Yes), and the processing goes to step S13. When the connection style of FIG. 1B is adopted, it is judged that there is no acknowledge (step S12; No), and the processing goes to step S14**.

In step S13, the controller 100 judges that the 4-wire type communication is adopted, and it keeps the switch 160 to OFF-state and finishes the processing. That is, the controller 100 judges that the connection style shown in FIG. 1A is adopted, and keeps the switch 160 to OFF-state.

Figure 8C:
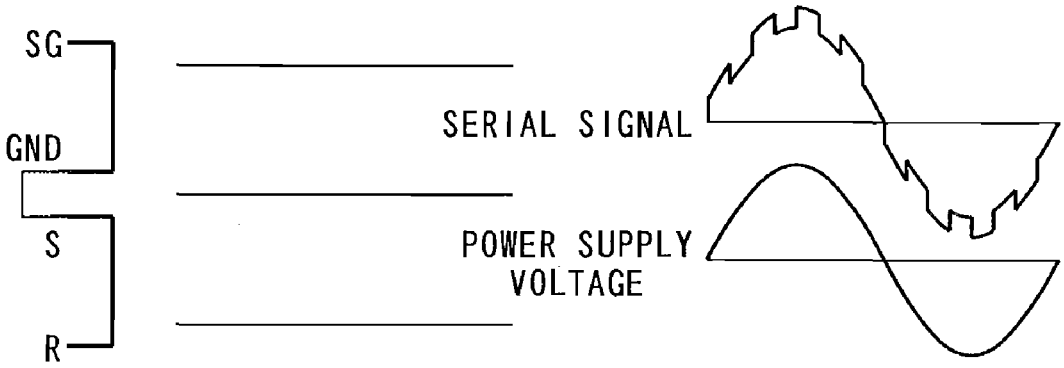
Figure 9B:
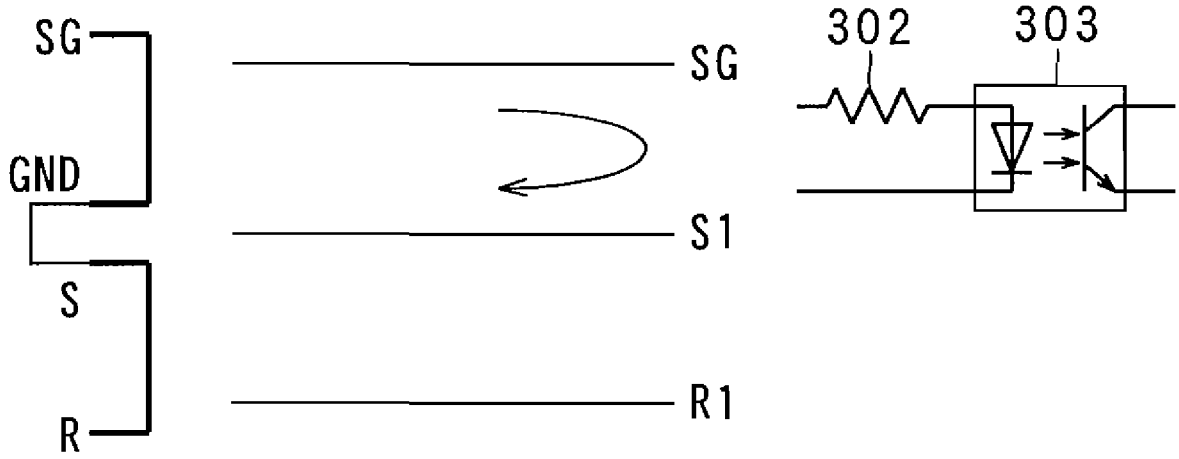

On the other hand, if No is judged in step S12, the processing goes to step S14, and the controller 100 sets the switch 150 to ON-state. As a result, the ground of the transmission circuit 110 and the reception circuit 120 and the S-phase of the power supply are set to be connected to each other. More specifically, as shown in FIG. 8B, when the switch 160 is set to ON-state, the S-phase and the ground (GND) are set to be connected to each other, and thus AC power and the serial signal are superposed and output as shown in FIG. 8C. As a result, as shown in FIG. 9B, the signal transmitted through the communication line SG and the power supply line S1 is received by the photocoupler 303.

In step S15, the controller 100 instructs the transmission circuit 110 to start the communication. As a result, the data supplied from the controller 100 are amplified by the transistors 111, 113 constituting the transmission circuit 110, and supplied to the photocoupler 115. The photocoupler 115 emits light from the built-in LED in accordance with the collector current of the transistor 113 and outputs the voltage corresponding to the intensity of the light from the built-in photodiode. The output of the photocoupler 115 is supplied to the transistor 118. The power from the transformer 191 is supplied to the transistor 118, and the transistor 118 switches the power source voltage in accordance with the output of the photocoupler 115 and outputs it to the resistors 130, 140.

At this time, when the connection style of FIG. 1B is adopted, as shown in FIG. 5, the signal output from the resistors 130, 140 is supplied to the indoor unit 21-1 to **21-*n* through the communication line SG and the power supply line S1. In the indoor unit 21-1 receiving such a signal, the reception signal is rectified by the diodes 221, 222, and the obtained signal is applied to the resistors 250, 260. The voltage appearing at the resistor 260 is waveform-shaped by the zener diode 301, and then supplied through the resistor 302 to the photocoupler 303. The photocoupler 303 outputs the voltage corresponding to the voltage supplied through the resistor 302, and supplies it to the transistor 305. The transistor 305 inverts and amplifies the output voltage of the photocoupler 303, and supplies it to the controller 310. The controller 310 received the serial signal recognizes that the signal from the outdoor unit 10 is received, and outputs an acknowledge signal thereto to the transistor 288. The transistors 288, 286 amplify the output of the controller 310, and supply it to the photocoupler 284. The voltage corresponding to the collector current of the transistor 286 is output from the photocoupler 284, and supplied to the transistor 281. The transistor 281 outputs the output voltage corresponding to the output of the photocoupler 284 to the resistors 250, 260. The voltage appearing at the resistors 250, 260 is transmitted through the communication line SG and the power supply line S1 to the outdoor unit 10. The above operation is executed independently in each indoor unit. However, the controller of each indoor unit monitors the state of the communication line SG and the power supply line S1 by the reception circuit, and transmits an acknowledge after it is checked that no signal is transmitted onto the communication line SG and the power supply line S1. Accordingly, signal collision on the communication line SG and the power supply line S1** is avoided.

The signal transmitted from the indoor unit 21-1 is transmitted to the outdoor unit 10 through the communication line SG and the power supply line S1. In the outdoor unit 10, the voltage supplied from the communication line SG and the power supply line S1 appear at the resistors 130, 140. The voltage appearing at the resistor 140 (the reception signal) is waveform-shaped by the zener diode 126, and then supplied to the photocoupler 124 through the resistor 125. The output corresponding to the voltage appearing at the resistor 140 occurs at the output side of the photocoupler 124, and the transistor 122 inverts and amplifies this output voltage and supplies it to the controller 100. The controller 100 receives the output voltage of the transistor 122, and restores it to the original data, thereby recognizing that there is an acknowledge from the indoor unit 21-1.

Alternatively, when the connection style of FIG. 1A is adopted, it is judged in step S12 that there is an acknowledge, and thus the processing of the step S14 and subsequent steps are not executed.

In step S16, if there is an acknowledge from the indoor unit (step S16; Yes), the processing goes to step S17. If there is no acknowledge (step S16; No), the processing goes to step S18. For example, when the connection style of FIG. 1B is adopted, an acknowledge is transmitted from the indoor unit, and thus the processing goes to step S17.

In step S17, the controller 100 judges that the 3-wire type communication is adopted, and keeps the switch 160 to ON-state. Accordingly, the outdoor unit 10 and the indoor units 21-1 to **21-*n*** are kept to a communication-possible state.

In step S18, the controller 100 judges a communication error because the communication is impossible by either the 4-wire type communication or the 3-wire type communication and thus wiring miss is assumed, for example, and thus the controller 100 finishes the processing. When a communication error occurs, an LED (not shown) or the like is turned on to notify this fact to the installation technician.

As described above, according to the first embodiment of the present invention, even when an indoor unit adopting any one of the communication systems shown in FIGS. 2 and 5 is connected to the outdoor unit 10, the outdoor unit 10 can automatically identify the communication system of the indoor unit, and set the switch 160 to ON-state or OFF-state on the basis of the identification result. Accordingly, the outdoor unit can be replaced or added irrespective of the type of the exiting indoor units. Therefore, the choice of the machine type is increased. The installation technician can shorten the time required for configuration because the outdoor unit 10 automatically selects the proper communication system insofar as wiring is accurately performed. Furthermore, even when communication cannot be performed by using any communication system, the installation technician is notified of the occurrence of a communication error. Therefore, the installation technician can rapidly know that the communication cannot be performed due to faulty wiring.

Furthermore, in the first embodiment of the present invention, the ground of the transmission circuit 110 and the ground of the reception circuit 120 are connected to the power supply line, so that the transmission and reception operation can be stably performed. The switch 160 is provided at the front stage of the noise filter 170, so that the serial signal can be prevented from being attenuated by the noise filter 170. Accordingly, stable communication can be performed.

Furthermore, in the first embodiment of the present invention, in the processing shown in FIG. 7, the switch 160 is first set to OFF-state to detect the communication system. When the communication system is detected under the state that the switch 160 is set to ON-state, there is a case where communication is possible even when the outdoor unit and the indoor units are connected by the 4-wire type communication. Therefore, there is a case where the switch 150 is erroneously set to ON-state. That is, in the case of the 4-wire type, the communication lines SG1, SG2 are connected to the indoor units 20-1 to **20-*n* irrespective of the state of the switch 160, and thus communication may be possible. On the other hand, when the switch 160** is set to OFF-state, in the case of the 3-wire type communication, communication is impossible because one of the communication lines is not connected. Therefore, in the first embodiment of the present invention, the detection is first performed under the state that the switch is set to OFF-state, so that the erroneous detection as described above can be prevented.

(C) Construction of Second Embodiment

Next, a second embodiment of the present invention will be described.

Figure 10:
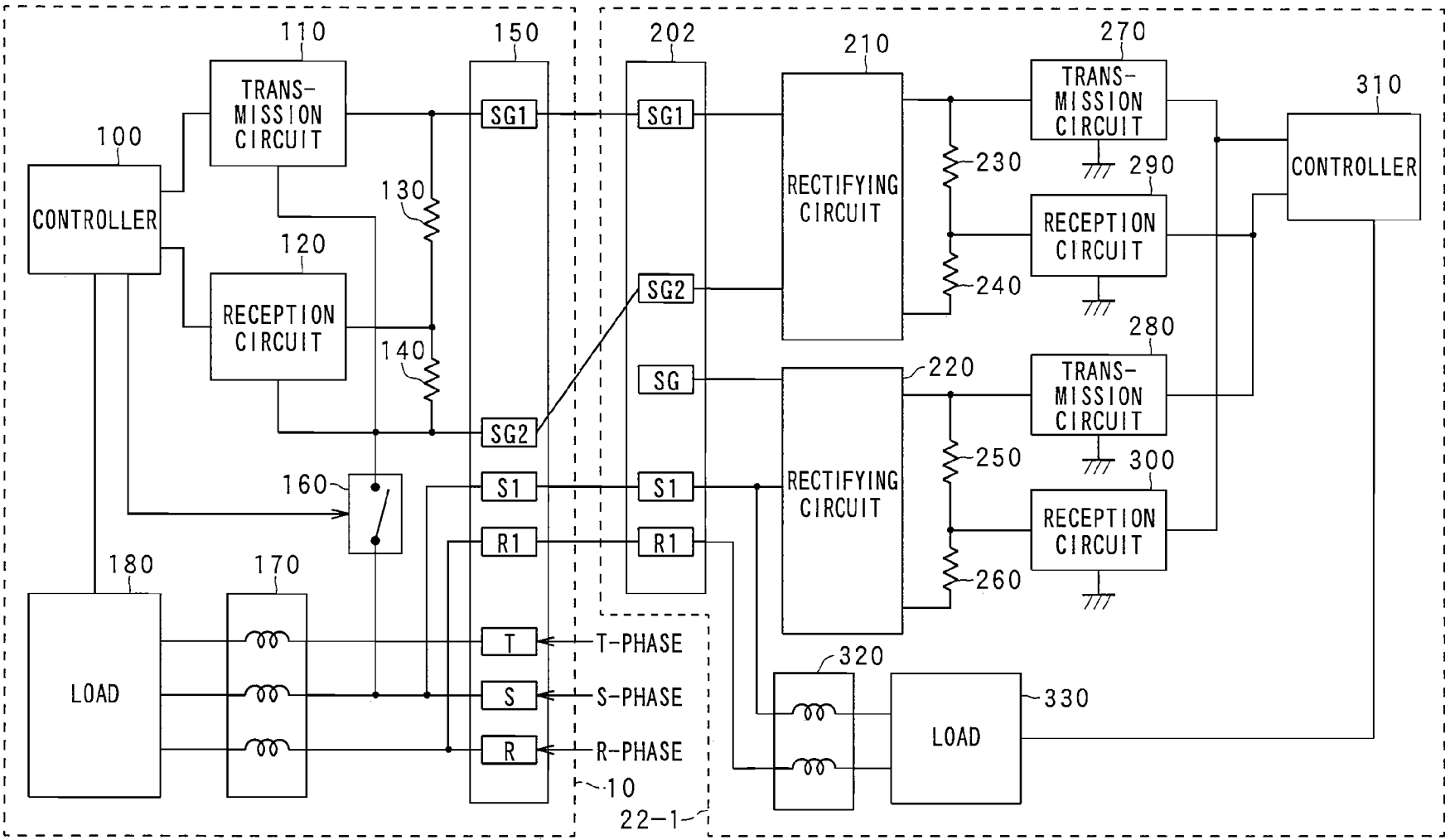
FIG. 10 shows the construction of the air conditioning system according to a second embodiment of the present invention.
Figure 11:
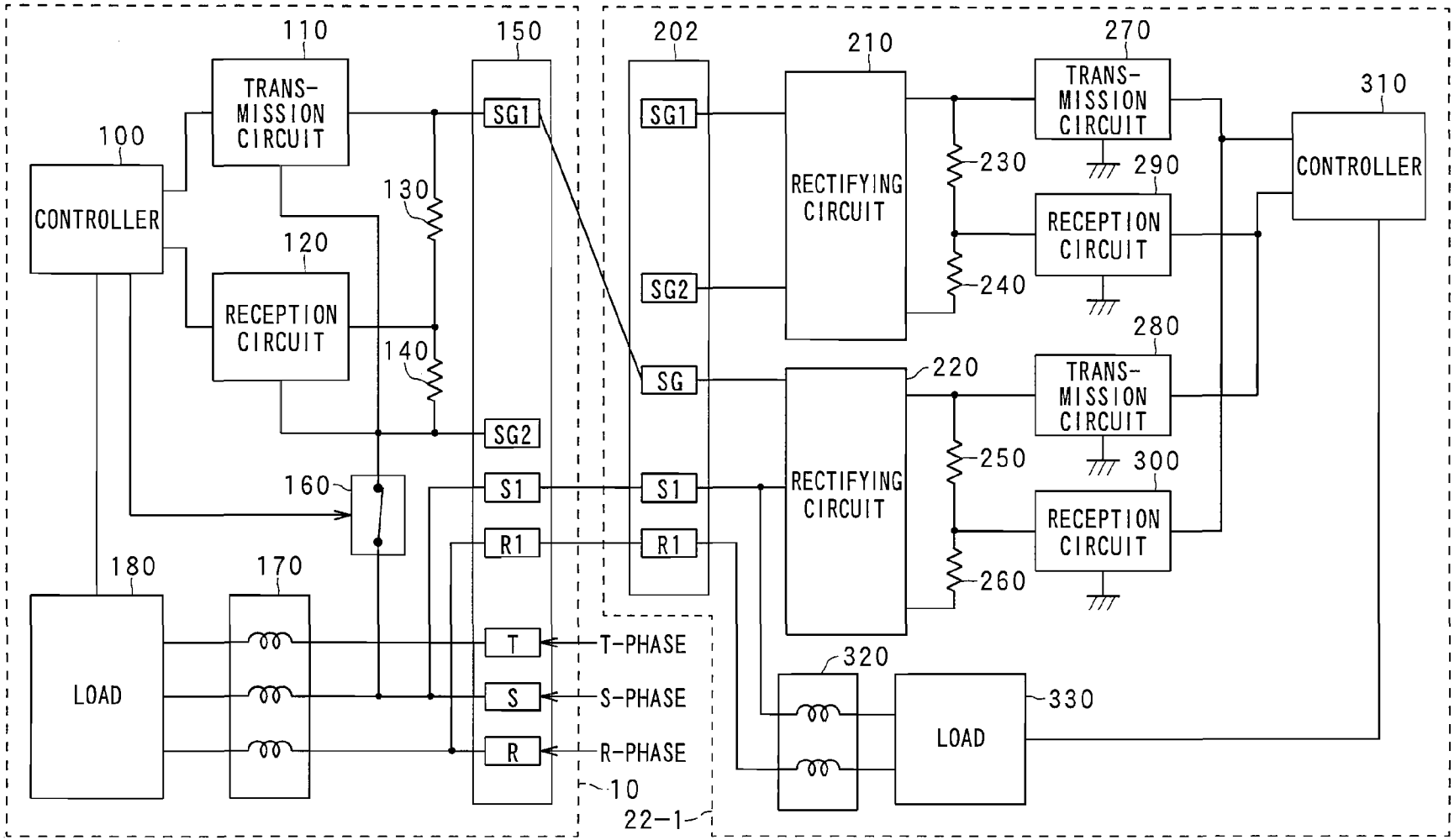
FIG. 11 is a diagram showing the construction of an air conditioning system according to the second embodiment of the present invention.

FIGS. 10 and 11 are block diagrams showing the construction of the second embodiment of the present invention. The second embodiment is different from the first embodiment in the construction of the indoor unit. The other construction of the second embodiment is the same as the first embodiment. As shown in FIGS. 10 and 11, the indoor unit 22-1 of the second embodiment has both the 4-wire type communication circuit (the transmission circuit 270, the reception circuit 290, etc.) and the 3-wire type communication circuit (the transmission circuit 280, the reception circuit 300, etc.), and either communication system can be selected in accordance with the method for the wiring between the outdoor unit and the indoor unit. That is, any one of the 4-wire type and the 3-wire type can be selected by selecting any one of the wiring style shown in FIG. 1A or the wiring style shown in FIG. 1B.

As shown in FIGS. 10 and 11, the indoor unit 22-1 mainly comprises a terminal table 202, rectifying circuits 210, 220, resistors 230 to 260, transmission circuits 270, 280, reception circuits 290, 300, a controller 310, a noise filter 320 and a load 330. The corresponding parts to those of FIGS. 2 and 5 are represented by the same reference numerals, and thus the detailed description of the respective constituent elements is omitted.

In FIG. 10, SG1 of the terminal table 150 and SG1 of the terminal table 202 are connected to each other, and SG2 of the terminal table 150 and SG2 of the terminal table 202 are connected to each other, whereby the 4-wire type communication is selected. In FIG. 11, SG1 of the terminal table and SG of the terminal table 202 are connected to each other, and SG2 of the terminal table 150 is set to an open state.

Figure 12:
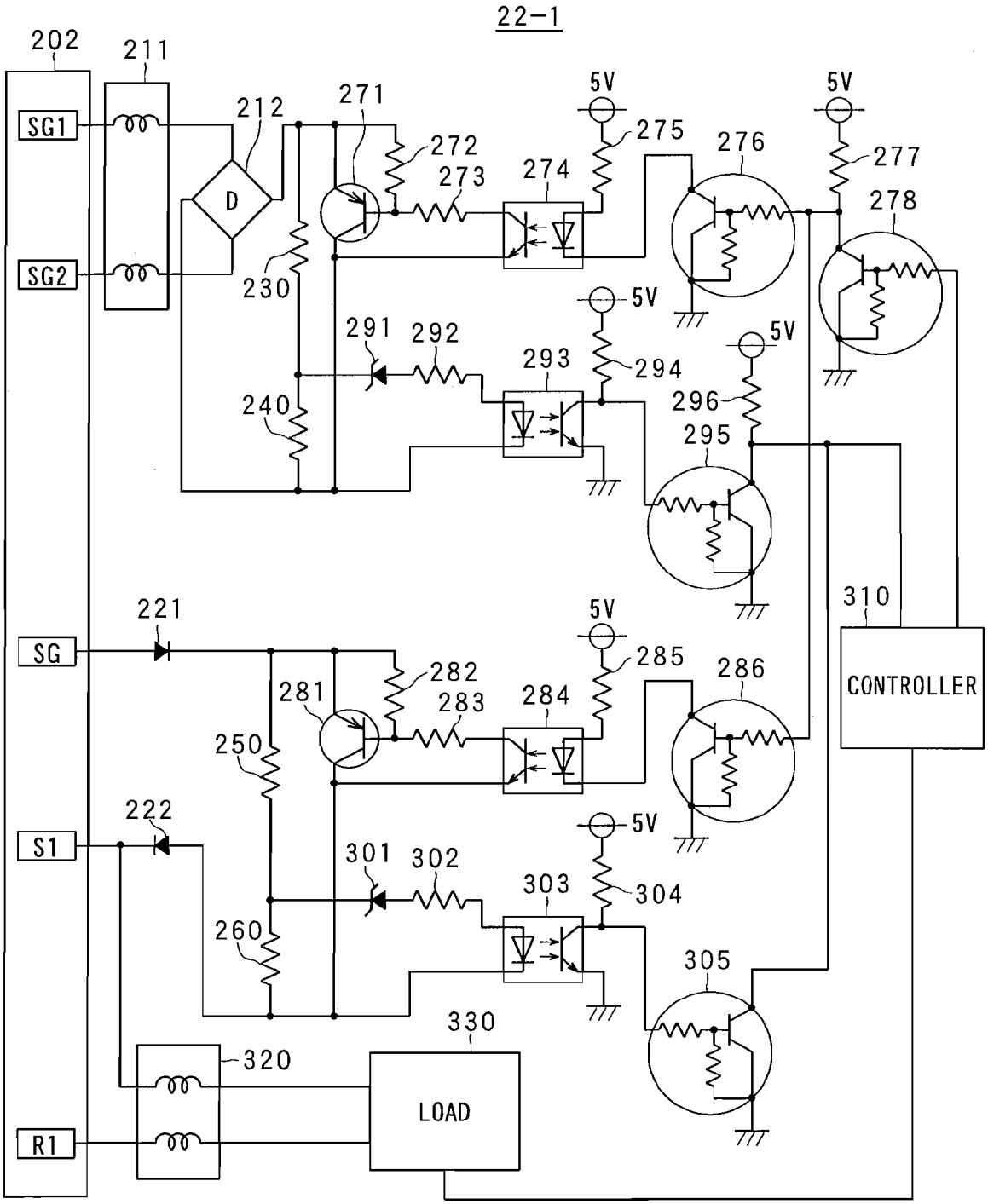
FIG. 12 is a circuit diagram showing the construction of the indoor unit shown in FIGS. 10 and 11.

FIG. 12 is a circuit diagram showing the detailed construction of the indoor unit 22-1 shown in FIGS. 10 and 11. In FIGS. 10 and 11, the corresponding parts to those of FIGS. 4 and 6 are represented by the same reference numerals, and the detailed description thereof is omitted. In the example shown in FIG. 12, as compared with the circuit construction of FIG. 6, the transistor 288 shown in FIG. 6 and the resistor 287 are omitted, and the transistor 278 and the resistor 277 are commonly used. Furthermore, the resistor 306 shown in FIG. 6 is omitted, and the resistor 296 is commonly used. In the example of FIG. 12, the terminal table 202 is newly provided in place of the terminal tables 200, 201. With respect to the terminal table 202, the communication lines SG1, SG2 and SG are connectable, and the power supply lines S1,R1 are connectable. The other construction is the same as those of FIGS. 4 and 6.

(D) Operation of Second Embodiment

Next, the operation of the second embodiment of the present invention will be described. The following description will be made by applying a case where an outdoor unit and an indoor unit are additionally provided under the state that an indoor unit and wiring exist or a case where an outdoor unit and an indoor unit are additionally provided under the state that wiring exists. More specifically, for example, an outdoor unit and an indoor unit are additionally provided under the state that the wiring shown in FIG. 1A or FIG. 1B has already existed, or an outdoor unit and an indoor unit are additionally provided under the state that the wiring and the indoor units shown in FIG. 1A or FIG. 1B have already existed.

For example, when an indoor unit and an outdoor unit are installed under the state that the wiring shown in FIG. 1A has already existed or the wiring and the indoor units shown in FIG. 1A have already existed, the installation technician connects the outdoor unit 10 and the indoor unit 22-1 by the wiring method shown in FIG. 10. That is, SG1, SG2 of the terminal table 150 are connected to SG1, SG2 of the terminal table 202, and also S1, R1 of the terminal table 150 are connected to S1, R1 of the terminal table 202.

Alternatively, when an indoor unit and an outdoor unit are installed under the state that the wiring and the indoor units shown in FIG. 1B have already existed, the installation technician connects the outdoor unit 10 and the indoor unit 22-1 by the wiring shown in FIG. 11. That is, SG1 of the terminal table 150 is connected to SG of the terminal table 202, and S1, R1 of the terminal table 150 are connected to S1, R1 of the terminal table 202.

When the wiring work and the installation work are completed, the installation technician turns on the power of the outdoor unit 10. As a result, the power supply to the respective parts of the outdoor unit 10 is started, and also the power supply to the respective indoor units is started through the power supply lines S1, R1. Subsequently, the controller 100 of the outdoor unit 10 executes the processing shown in FIG. 7.

As a result when the connection style shown in FIG. 10 is adopted, the communication is executed between the transmission circuit 270 and the reception circuit 290 in step S11, and thus "Yes" is judged in step S12. Accordingly, the processing goes to step S13 to fix the switch 160 to OFF-state and select the 4-wire type communication. Furthermore, when the connection style shown in FIG. 11 is adopted, the communication is executed between the transmission circuit 280 and the reception circuit 200 in step S15, and thus "Yes" is judged in step S16. Therefore, the processing goes to step S17 to fix the switch 160 to ON-state and select the 3-wire type communication. As a result, the communication can be normally executed between the indoor units and the outdoor unit irrespective of the state of the existing facilities.

As described above, in the second embodiment of the preset invention, both the 4-wire type communication circuit and the 3-wire type communication circuit are provided for the indoor units. Therefore, anew indoor unit can be additionally provided or replaced irrespective of whether the existing facilities adopt the 4-wire type communication or the 3-wire type communication.

Furthermore, the outdoor unit 10 automatically recognizes which one of the 4-wire type and the 3-wire type is selected, and sets the switch 160 to ON-state or OFF-state on the basis of the recognition result through the above processing, whereby the load of the installation technician can be reduced.

Furthermore, in the second embodiment of the present invention, the switch 160 is first set to OFF-state and the communication style is detected by the processing shown in FIG. 7. Therefore, error detection can be prevented as described above.

(E) Modifications

The present invention is not limited to the above-described embodiments, and various modifications and applications may be made without departing from the subject matter of the present invention. For example, the circuit constructions shown in FIGS. 3, 4, 6, 12 are examples, and other circuit constructions may be adopted.

In the above-described embodiments, the switch 160 is the electromagnetic relay. However, a semiconductor switch or the like may be used. Furthermore, in the above-described embodiments, the switch 160 is connected to the S-phase. However, the switch 160 may be connected to the other phases (for example, R-phase). Still furthermore, the noise filter 170 may be omitted.

In the above-described embodiments, the switch 160 is automatically set. For example, the switch 160 may be a manual switch so that the installation technician can manually set the switch 160. For example, when the 3-wire type is selected, the manual switch is set to ON-state, and when the 4-wire type is selected, the manual switch is set to Off-state. By using this method, new equipment can be also additionally provided or replaced and normal communication can be performed irrespective of the state of the existing facilities.

In the above-described embodiments, the air conditioning system is constructed by the outdoor unit 10 and the indoor units 20-1 to **20-*n*, the indoor units 21-1 to 21-*n* or the indoor units 22-1 to 22-*n***. However, in addition to these constructions, a central control unit and an interface device may be added as occasion demands. Furthermore, the number of indoor units may be one or more.

In the second embodiment, the outdoor unit 10 is provided with the function of automatically detecting the communication system by the switch 160. However, the indoor unit 22-1 shown in FIGS. 10, 11 may be connected to an outdoor unit which does not have the above function. In this case, in the case of the 4-wire type outdoor unit, the wiring method shown in FIG. 10 may be adopted. In the case of the 3-wire type outdoor unit, the wiring method shown in FIG. 11 may be adopted. According to this embodiment, an indoor unit can be additionally provided or replaced irrespective of the type of the existing outdoor unit.

Thus, while there have been shown, described, and pointed out fundamental novel features of the invention as applied to several embodiments, it will be understood that various omissions, substitutions, and changes in the form and details of the devices illustrated, and in their operation, may be made by those skilled in the art without departing from the spirit and scope of the invention. Substitutions of elements from one embodiment to another are also fully intended and contemplated. It is also to be understood that the drawings are not necessarily drawn to scale, but that they are merely conceptual in nature. The invention is defined solely with regard to the claims appended hereto, and equivalents of the recitations therein.

I claim:

1. An air conditioning system comprising:

an indoor unit and an outdoor unit connected to each other through common power supply lines;

the indoor unit comprising:

a first communications circuit configured to perform communication with the outdoor unit through at least one of a first communication line and a second communication line independent of the common power supply lines;

a second communication circuit configured to perform communication through at least one of the two common power supply lines and a third communication line independent of the at least two common power supply lines;

the outdoor unit comprising:

a third communication circuit, having a communication terminal, configured to communicate with at least one of the first communication circuit and the second communication circuit;

a switch configured to connect or disconnect the communication terminal of the third communication circuit and one of the common power supply lines on the basis of a connection status between the third communication circuit and each of the first communication circuit and the second communication circuit; and a judging circuit configured to control the switch connection and disconnection, and further configured to transmit a predetermined signal to the indoor unit, wherein the judging circuit is further configured to judge, based on the presence or absence of an acknowledge signal from the indoor unit, whether the first communication circuit and the second communication circuit is connected to the outdoor unit.

2. The air conditioning system according to claim 1, wherein the judging circuit is further configured to judge when the switch is first set to the disconnection state.

3. The air conditioning system according to claim 1, wherein the indoor unit further comprises both the first communication circuit and the second communication circuit, and the judging circuit of the outdoor unit is further configured to judge which of the first communication circuit and the second communication circuit is connected to the outdoor unit.

4. The air conditioning system according to claim 1, wherein the switch is further configured to connect the communication terminal to one of the common power supply lines when the third communication circuit is connected to the second communication circuit, and further configured to disconnect the communication terminal from one of the common power supply lines when the third communication circuit is connected to the first communication circuit.

5. The air conditioning system according to claim 1, wherein the communication terminal of the third communication circuit is connected through the switch to a ground of the third communication circuit.

6. An outdoor unit connected through common power supply lines to an indoor unit having at least one of a first communication circuit configured to perform communication through two communication lines independent of the power supply lines and a second communication circuit configured to perform communication through one of the common power supply lines and one communication line independent of the common power supply lines, the outdoor unit comprising:

a third communication circuit configured to communicate with at least one of the first communication circuit and the second communication circuit, wherein the third communication circuit includes a plurality of communication terminals;

a switch configured to connect and disconnect one of the plurality of communication terminals of the third communication circuit and one of the power supply lines based on a connection status between the third communication circuit and each of the first communication circuits and the second communication circuit;

a judging circuit configured to set the switch to a connection state when at least one of the plurality of communication terminals is connected to one of the power supply lines and further configured to set the switch to a disconnection state when the one of the plurality of communication terminals is disconnected from the one of the power supply lines, wherein the judging circuit is configured to transmit a predetermined signal to the indoor unit under each of the connection state and the disconnection state; and the judging circuit further configured to judge, based on a presence or an absence of an acknowledge signal sent in response to the predetermined signal, whether at least one of the first communication circuit and the second communication circuit is connected to the outdoor unit.

7. A communication control method for an air conditioning system having an indoor unit and an outdoor unit connected through common power supply lines, wherein the indoor unit has at least one of a first communication circuit configured to communicate through two communication lines that are independent of the common power supply lines and a second communication circuit configured to communicate through one of the common power supply lines and a communication line independent of the common power supply lines, wherein the outdoor unit has a third communication circuit configured to communicate with at least one of the first communication circuit and the second communication circuit, a switch configured to switch between a connection and a disconnection of at least one communication terminal of the third communication circuit and one of the common power supply lines based on a connection status between the third communication circuit and each of the first communication circuit and the second communication circuit, the method comprising the steps of:

setting a switch to a connection state when the one communication terminal is connected to one of the common power supply lines;

setting the switch to a disconnection state when the one communication terminal is disconnected from one of the common power supply lines;

transmitting a predetermined signal to the indoor unit under each of the connection state and the disconnection state; and judging, based on the presence or absence of an acknowledge signal from the indoor unit, whether the first communication circuit and the second communication circuit is connected to the outdoor unit.

* * * * *